United States Patent [19]

Anderson

[11] Patent Number: 4,941,421

[45] Date of Patent: Jul. 17, 1990

[54] STEERING MECHANISM FOR AQUATIC VEHICLE

[75] Inventor: Ron L. Anderson, Irvine, Calif.

[73] Assignee: Suzuki Jidosha Kogyo Kabushiki Kaisha, Japan

[21] Appl. No.: 248,369

[22] Filed: Sep. 23, 1988

[51] Int. Cl.[5] ..... B63H 25/02

[52] U.S. Cl. ..... 114/144 R; 74/492; 74/493

[58] Field of Search ..... 114/144 R, 146, 147, 114/153, 154, 155, 160, 161; 441/65; 440/53; 244/234; 180/332, 333, 78; 280/775, 779, 780; 74/484 R, 485, 489, 492, 493, 543, 537.8, 351.1–551.4

[56] References Cited

U.S. PATENT DOCUMENTS

| | | | |
|---|---|---|---|
| 4,262,619 | 4/1981 | Hine | 114/144 R |
| 4,537,089 | 8/1985 | Moneta | 74/493 |
| 4,553,496 | 11/1985 | Foresman | 114/144 R |
| 4,644,891 | 2/1987 | Niina | 114/201 R |
| 4,726,311 | 2/1988 | Niina | 114/144 R |
| 4,745,872 | 5/1988 | Nakamura | 114/144 R |
| 4,748,928 | 6/1988 | Nakamura | 114/144 R |

*Primary Examiner*—Joseph F. Peters, Jr.
*Assistant Examiner*—Clifford T. Bartz
*Attorney, Agent, or Firm*—Bruce L. Adams; Van C. Wilks

[57] ABSTRACT

A steering mechanism of an aquatic vehicle having a hull comprises a stationary housing secured to the hull on a deck side thereof, a movable housing to be engaged with the stationary housing, and a steering pole having a base end secured to the movable housing and a free end to which a handle member is secured. Either one of the stationary housing and the movable housing is provided with arcuate guide grooves each having an imaginary center of curvature about which the steering pole is rotated and which is positioned in the inner side of the hull and a movable mechanism to be engaged with the arcuate grooves is disposed on the other one of the stationary housing and the movable housing.

11 Claims, 6 Drawing Sheets

STEERING MECHANISM FOR AQUATIC VEHICLE

BACKGROUND OF THE INVENTION

This invention relates to a steering mechanism of a power driven aquatic vehicle for use with, for example, a gliding boat for a hydroski or water-jet type boat or ship.

A user of an aquatic vehicle utilized as a gliding boat for a hydroski or water-jet type boat has to stably operate or steer the steering mechanism of the aquatic vehicle in response to the advancing speed thereof while maintaining the balance of his posture. There are however personal differences among the users in their follow-up abilities in response to the change of speed of the aquatic vehicle and in their physical structures in order to handle the aquatic vehicle while maintaining their balance. The operating postures of the users are therefore inevitably changed in accordance with the extents of the rolling or curving of the aquatic vehicle.

A conventional aquatic vehicle such as disclosed in Japanese Patent Publication No. 35318/1976 in consideration of the above matters is equipped with a steering mechanism capable of adjusting the height of the same. FIGS. 6 and 7 show an aquatic vehicle equipted with the steering mechanism of the character described above, in which a base end of a steering pole 1 is secured to a hull to be pivotable about a support shaft 3, and the steering pole 1 is in the full-standing position A by virtue of the urging force of a spring 4 when no steering force is applied to the steering mechanism. When a handle lever 6 connected to the free end of the steering pole 1 is moved from the full-down position B, i.e., the most downward position, to the full-standing position A, i.e., the most upward position, the handle lever 6 describes a circular locus about the supporting shaft 3.

With the conventional steering mechanism of the aquatic vehicle having the steering pole 1 secured by a pivotal connection at the base end to the supporting shaft 3, the circular locus is described by the handle lever 6 when the handle lever 6 moves from the full-down position B to the full-standing position A, so that a user who now mounts or stands on the hull is obliged to once make a backward movement because of the circular movement of the handle lever 6. In addition, when the user gets on a boat, the steering pole 1, i.e., the handle lever 6, is in the full-standing position A by means of the spring force relatively far away from the standing position, thus being inconvenient for maneuvering the handle lever 6.

Moreover, in the conventional structure, as described above, the base end of the steering pole 1 is pivotably supported by the supporting shaft 3 located in and near the outer surface of the hull 2, and accordingly, the base end of the steering pole 1 has to be positioned near the outer surface of the hull 2 due to the limitation of the inner structure of the hull 2, thus restricting the freedom of the design thereof.

SUMMARY OF THE INVENTION

An object of this invention is to obviate the defects or drawbacks encountered in the conventional technique described above and to provide a steering mechanism of a power driven aquatic vehicle capable of improving the maneuverability of a handle member of the steering mechanism without being restricted by an inner structure of the aquatic vehicle.

Another object of this invention is to provide a steering mechanism of a power driven aquatic vehicle provided with a movable mechanism for improving the maneuverability of the handle member of the steering mechanism for a user who stands on a hull of the aquatic vehicle without giving any inconvenience during the operation thereof while enabling the user to maintain the balance of his posture on the hull.

These and other objects can be achieved according to this invention by providing a steering mechanism of an aquatic vehicle having a hull comprising a stationary housing secured to the hull on a deck side thereof, a movable housing to be engaged with the stationary housing, a steering pole having a base end secured to the movable housing and a free end to which a handle member is secured, arcuate grooves formed on side surfaces of either one of the stationary housing and the movable housing, and a movable mechanism disposed on the other one of the stationary housing and the movable housing to be engageable with the arcuate grooves and to be movable therealong.

In a preferred embodiment, the movable mechanism may comprise a plurality of rollers or sliders or combination thereof which are guided along the arcuate grooves.

The movable housing may be disposed inside the stationary housing, and in this case, adjusters may be provided for adjusting the width of the movable housing.

According to the steering mechanism of an aquatic vehicle having the construction described above, the movable housing to which the steering pole and hence the handle member is secured is guided along the guide grooves each having an arcuate configuration having an imaginary center of curvature being positioned in the hull without being restricted by the inner structure of the hull. Accordingly, the movement of the handle member from the full-down position to the full-standing position can be achieved smoothly with an improved locus thereof and the maneuverability of the handle member can be improved without disturbing the standing or handling position of the user on the hull so that he can maintain his steering balance.

The preferred embodiments according to this invention will be described more in detail hereunder with reference to the accompanying drawings.

DESCRIPTION OF THE PREFERRED EMBODIMENTS

Figure 1:
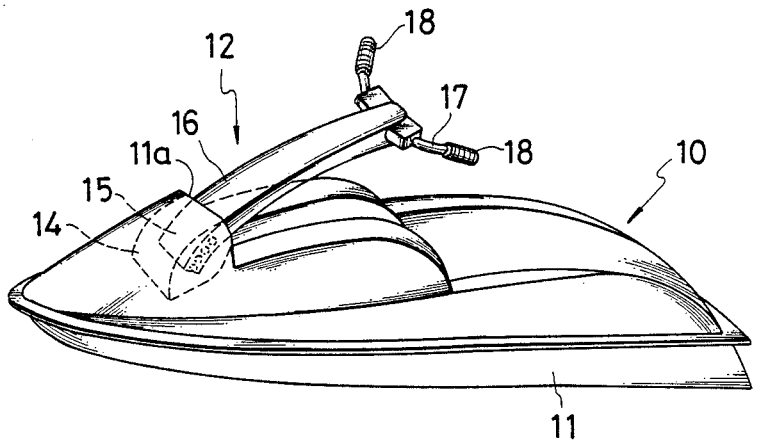
FIG. 1 is a perspective view of an aquatic vehicle provided with a steering mechanism according to this invention.

An aquatic vehicle 10 shown in FIG. 1 as a perspective view is provided with a steering mechanism 12 having a base end mounted to a bow side of a hull 11. A deck-side stationary housing 14 is secured to the bow side of the hull 11 and a movable housing 15 is movably mounted in the deck-side stationary housing 14. The stationary housing 14 is located in an upper cover 11*a* of the hull 11 so as not to project thereover. The steering mechanism 12 includes a steering pole 16 having a base end mounted to the movable housing 15 and a handle member 17 provided with handle grips 18 at both ends thereof is secured to a free end of the steering pole 16.

Figure 3:
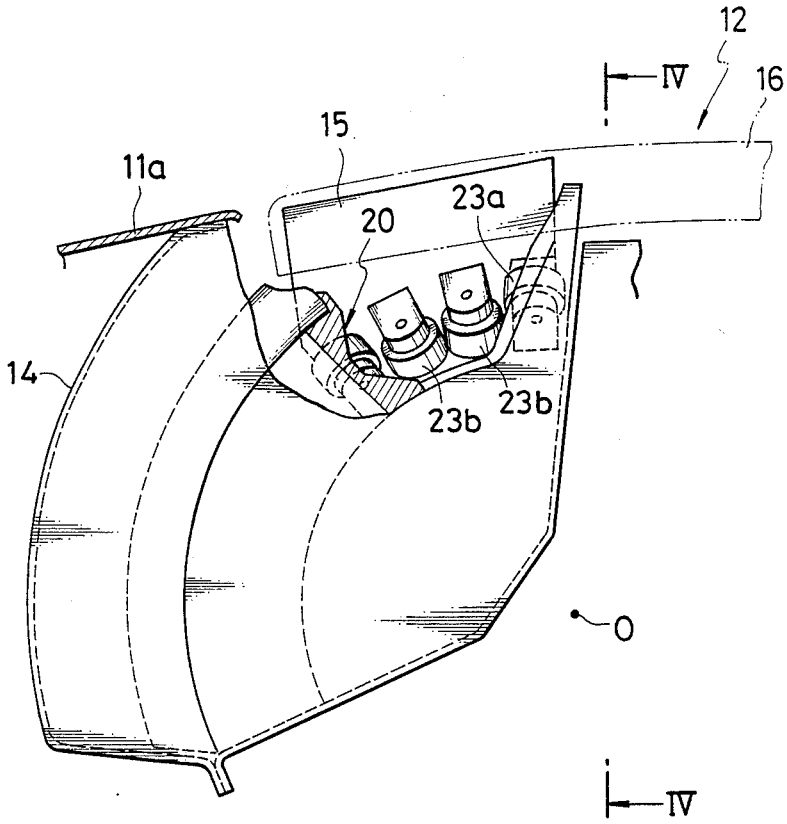
FIG. 3 is a side view partially broken away of a supporting structure of the steering mechanism shown in FIG. 1.
Figure 4:
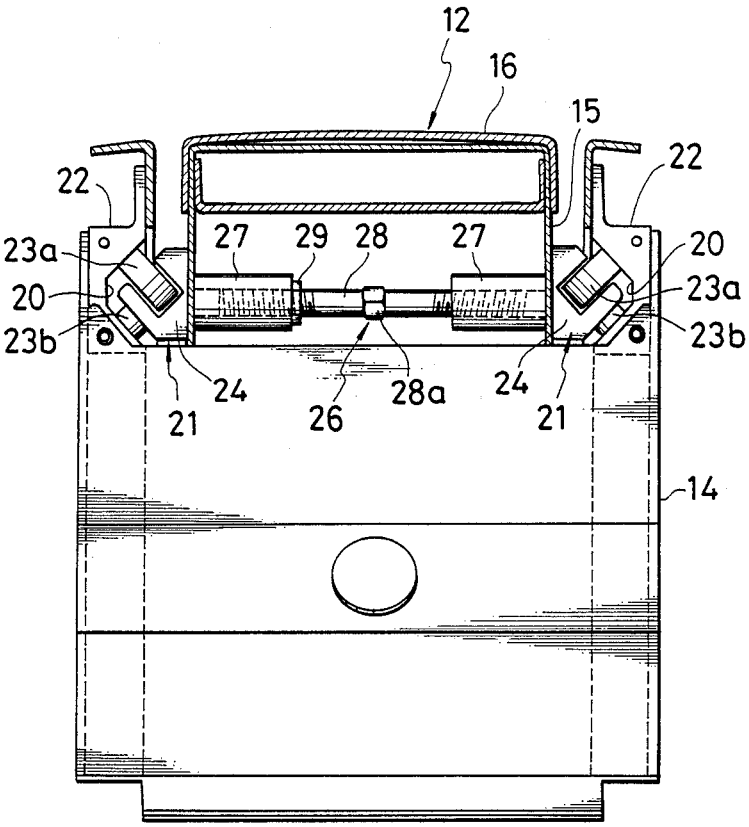
FIG. 4 is a sectional view taken along the line IV—IV shown in FIG. 3 for showing a movable mechanism of the steering mechanism.

As shown in FIGS. 3 and 4, the stationary housing 14 is provided with bilateral inner walls in which guide grooves 20 are preferably formed each having a substantially arcuate configuration and V-shape in cross section, but not necessarily limited to this shape. A movable mechanism 21, which will be described in detail hereinafter, is engaged with the guide grooves 20 to be movable therealong. Although in the illustrated embodiment, the guide grooves 20 are formed on guide locks 22 secured to the bilateral inner surfaces of the stationary housing 14, the guide grooves 20 may be directly formed on the inner surfaces thereof.

The movable mechanism 21 includes a plurality of rollers 23*a* and 23*b* engageable with side surfaces of the arcuate grooves 20 and arranged respectively in plural numbers along the passages of the grooves 20, the rollers 23*a* and 23*b* being rotatably supported by brackets 24 secured to the bilateral outer surfaces of the movable housing 15.

More in detail, in case each groove 20 has a V-shaped cross section, the respective two, for example, rollers 23*a* and 23*b* are engaged to be rollable with the inclined inner side surfaces of the arcuate grooves 20. The movable housing 15 is therefore guided along the arcuate grooves 20 and hence the steering pole 16 operatively secured to the movable housing 15 can be rotated or angularly displaced about the center O of curvature of the arcuate grooves 20. The center O of curvature is an imaginary center of rotation positioned inside the hull 11, thus being positioned therein without being restricted by the inner structure of the hull 11.

Figure 2:
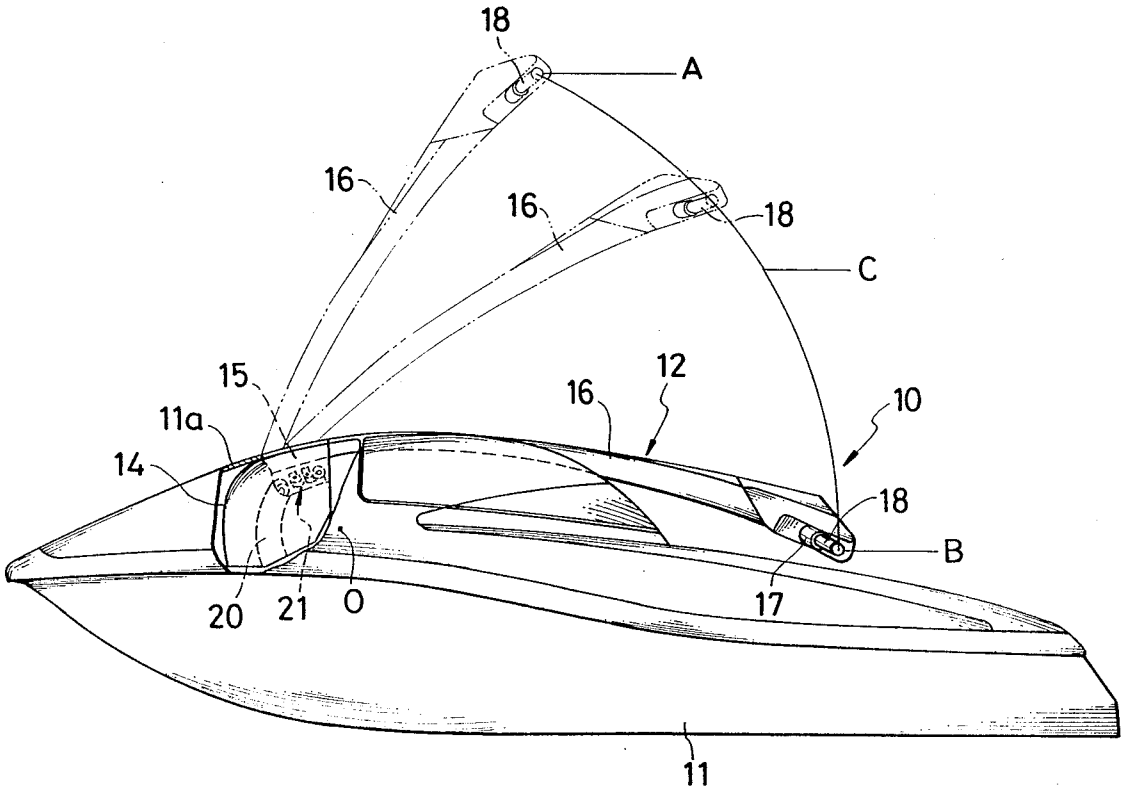
FIG. 2 is a side view of the aquatic vehicle shown in FIG. 1.

In actual operation, since the center O of the curvature of the arcuate grooves 20 is positioned inside the hull 11 as shown in FIG. 2, the locus C of the handle grip 18 in a case where the steering mechanism 12 is moved from the full-down position B towards the full-standing position A can be described without moving rearwardly at all. Accordingly, the user can maneuver the handle member 17 without changing his standing position, thus improving the steering ability of the handle member 17.

Adjusters 26 are located at least at two portions of the front and rear portions of the movable housing 15 as mechanically reinforcing members, the adjusters 26 being operated for adjusting the width of the movable housing 15 so as not to deform the same by a force transmitted through the movable mechanism 21.

Each adjuster 26 comprises a pair of hollow stationary adjusting blocks 27 each of boss-shape located on the inside surfaces of both sides of the movable housing 15 so as to oppose each other, an adjusting rod 28 provided with screw threads on both end portions thereof which are engaged with screw threads formed on the surfaces of bores formed in the adjusting blocks 27, and a locking nut or double locking nuts 29 mounted to the rod 28 for locking the rotation of the adjusting rod 28. The threads of the adjusting rod 28 are different in cutting directions, one being a right handed screw and the other being a left handed screw, and a nut 28*a* is mounted to the rod 28 at substantially the central portion thereof for freely adjusting the width of the movable housing 15 by rotating the nut 28*a*.

The steering mechanism 12 of the aquatic vehicle according to this invention has the structure described above, so that the movable housing 15 to which the base end of the steering pole 16 of the steering mechanism 12 can be smoothly guided along the arcuate guide grooves 20 of the housing 14 by the movable mechanism 21. Accordingly, the handle member 17 attached to the free end portion of the steering pole 16 can be suitably moved in the vertical and longitudinal directions with respect to the hull 11 between the full-down position B and the full-standing position A as shown in FIG. 2 without being restricted by the inner structure of the hull 11. The user of the aquatic vehicle can therefore freely change his steering position in accordance with the change of driving speed, rolling or curving degree or condition, thus enjoying the improved steering operation.

The handle member 17 of the steering mechanism 12 may be manually maintained at the full-down position B or full-standing position A by applying the urging force of a spring means, not shown.

Figure 5:
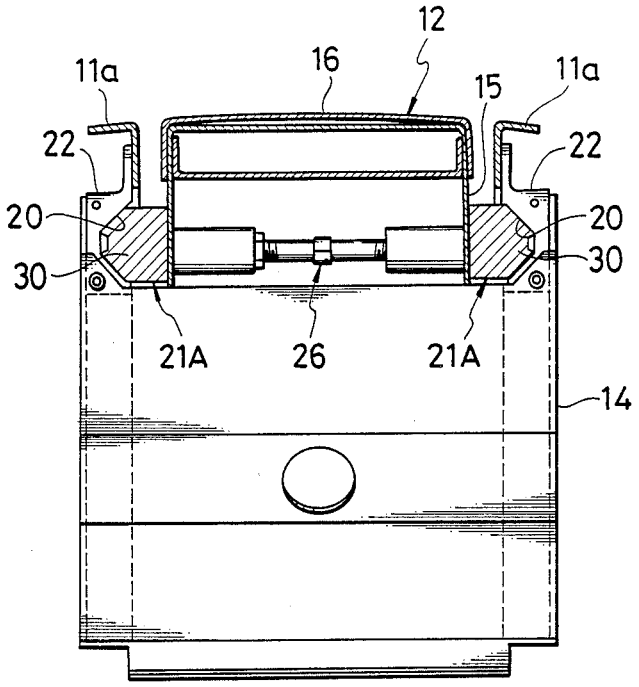
FIG. 5 is an illustration of a modification of FIG. 4.
Figure 6:
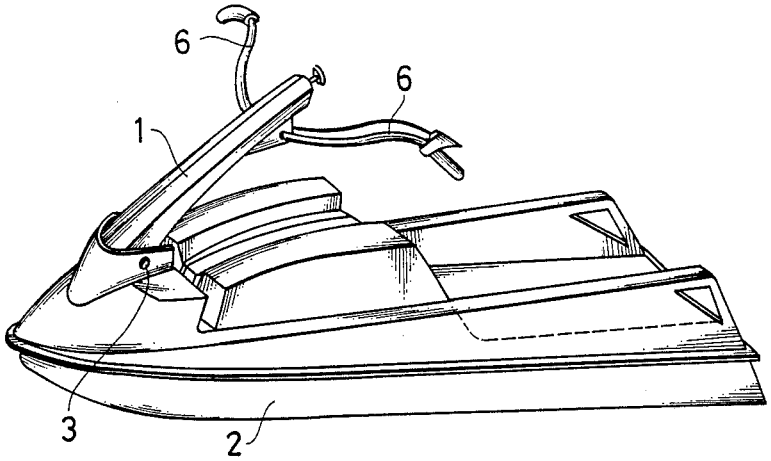
FIG. 6 PRIOR ART
FIGS. 6 and 7 are perspective views of an aquatic vehicle of conventional type.
Figure 7:
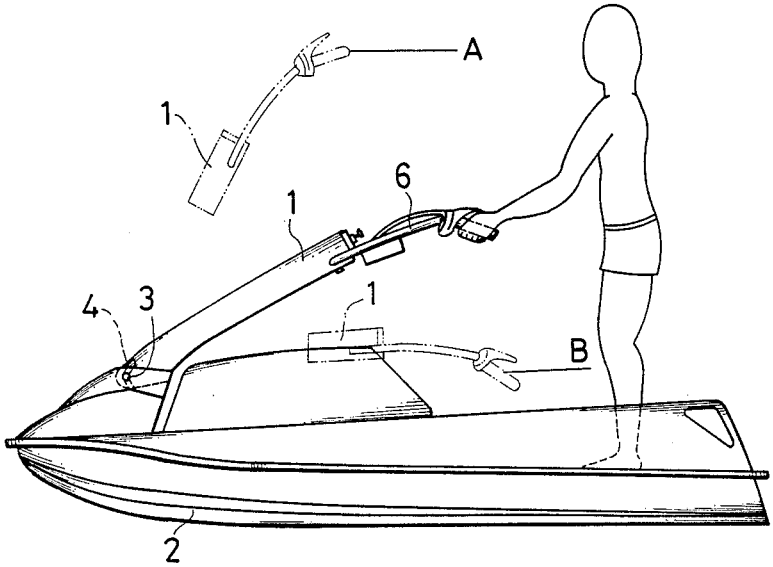
FIG. 7 PRIOR ART

In the aforementioned embodiment, the movable mechanism is equipped with the rollers, but in a modification thereof, the movable mechanism 21 may be substituted with a movable mechanism 21A such as shown in FIG. 5 in which sliders 30 are secured to the outer surfaces of both sides of the movable housing 15 instead of the rollers. In this modification, the sliders 30 each have a configuration slidably engageable with the arcuate shape of the corresponding guide groove 20 and also has a longitudinal length along the extending direction of the guide groove 20, the longitudinal length being optionally determined by the number of the sliders 30 to be engaged with the corresponding guide grooves 20. Moreover, the combination of the sliders 30 and the rollers 23 may be adopted for the movable mechanism 20A.

In another modification, the movable mechanism may be provided for the deck side stationary housing and the arcuate guide grooves formed in the movable housing instead of the aforementioned embodiment in which the movable mechanism is provided for the movable housing and the arcuate guide grooves are formed in the stationary housing.

In a further modification, the movable housing may be located so as to cover the stationary housing secured to the hull side of the aquatic vehicle in a manner such that the guide grooves are formed in one of the outer surfaces of both sides of the stationary housing and the inner surfaces of both sides of the movable housing, and the movable mechanism is provided for the other one thereof instead of the described embodiment in which the movable housing is accommodated in the stationary housing.

It should also be understood that the present invention is not limited to the described embodiments, and other various changes and modifications may be made within the scope of the appended claims.

What is claimed is:

1. A steering mechanism for an aquatic vehicle having a hull comprising:

a stationary housing secured to the hull on a deckside thereof;

a movable housing movable relative to said stationary housing;

a steering pole having one end as a base end secured to said movable housing and the other end as a free end to which a handle member is secured;

guide means disposed on said surfaces of either one of said stationary housing and said movable housing; and a movable mechanism disposed on the other one of said stationary housing and said movable housing and engageable with said guide means and movable therealong, said movable mechanism comprising a plurality of rollers in rolling engagement with said guide means and rollable therealong.

2. The steering mechanism according to claim 1 wherein said guide means are grooves each having an arcuate configuration having an imaginary center of curvature bout which said steering pole is rotated.

3. The steering mechanism according to claim 2 wherein said center of curvature is positioned inside the hull.

4. Steering mechanism for an aquatic vehicle having a hull, comprising: a steering member having a lower end and an upper end; a handle member attached to the upper end of the steering member; and means mounting the lower end of the steering member to undergo upward and downward displacement along an arcuate locus relative to the hull to enable corresponding lowering and raising of the upper end of the steering member and handle member.

5. A steering mechanism according to claim 4; wherein the means mounting comprises means defining a pair of spaced-apart arcuate grooves defining the arcuate locus and connected to one of the hull or the steering member, and movable means connected to the other of the hull or steering member and movable along the arucate grooves accompanied by displacement of the steering member.

6. A steering mechanism according to claim 5; wherein the movable means comprises a movable housing having rollers rotatably mounted thereon, the rollers being rollable along the arcuate grooves.

7. A steering mechanism according to claim 5; wherein the movable means comprises a movable housing having sliders secured thereto, the sliders being slidable along the arcuate grooves.

8. A steering mechanism for an aquatic vehicle having a hull comprising:

a stationary housing secured to the hull on a deck side thereof;

a movable housing movable relative to said stationary housing;

a steering pole having one end as a base end secured to said movable housing and the other end as a free end to which a handle member is secured;

9. The steering mechanism according to claim 8; wherein said movable mechanism comprises a plurality of rollers engageable with said guide means and rollable therealong.

10. The steering mechanism according to claim 8; wherein said movable mechanism comprises slider means having an outer configuration slidably engageable with said guide means and slidable therealong.

11. The steering mechanism according to claim 8; further including means for adjusting a width of said movable housing, said adjusting means comprising a pair of hollow stationary adjusting blocks secured to inner surfaces of said movable housing so as to oppose each other, an adjusting rod provided with threads on both end portions thereof which are engaged with threads formed in inner surfaces of said hollow adjusting blocks, and a locking nut mounted on said rod for locking the rotation of the adjusting rod.

* * * * *